US005768655A

United States Patent [19]

Yoshino et al.

[11] Patent Number: 5,768,655

[45] Date of Patent: Jun. 16, 1998

[54] IMAGE FORMING APPARATUS AND CONTROL METHOD THEREOF

[75] Inventors: Kunihisa Yoshino; Yoshiko Matsuoka; Jun Yokobori; Michio Osada; Akitoshi Matsubara, all of Hachioji, Japan

[73] Assignee: Konica Corporation, Tokyo, Japan

[21] Appl. No.: 800,868

[22] Filed: Feb. 14, 1997

[30] Foreign Application Priority Data

Feb. 20, 1996 [JP] Japan ..... 8-031668

[51] Int. Cl.[6] ..... G03G 15/20

[52] U.S. Cl. ..... 399/69; 219/216; 399/67

[58] Field of Search ..... 399/67–70, 328, 399/330; 219/216, 469–471

[56] References Cited

U.S. PATENT DOCUMENTS

| | | | |
|---|---|---|---|
| 4,480,908 | 11/1984 | Anzai et al. | 399/70 |
| 4,603,245 | 7/1986 | Yagasaki | 219/216 |
| 4,737,818 | 4/1988 | Tanaka et al. | 399/70 |
| 5,109,255 | 4/1992 | Nishikawa et al. | 399/70 |
| 5,280,328 | 1/1994 | Goto et al. | 399/70 |
| 5,303,015 | 4/1994 | Sato | 399/69 |
| 5,426,494 | 6/1995 | Muto et al. | 399/335 |
| 5,561,512 | 10/1996 | Fukano et al. | 399/69 |

FOREIGN PATENT DOCUMENTS

| | | |
|---|---|---|
| 2-213888 | 8/1990 | Japan . |
| 4-037887 | 2/1992 | Japan . |
| 5-197246 | 8/1993 | Japan . |
| 6-332330 | 12/1994 | Japan . |
| 7-072676 | 3/1995 | Japan . |
| 8-152807 | 6/1996 | Japan . |

*Primary Examiner*—Matthew S. Smith

*Attorney, Agent, or Firm*—Frishauf, Holtz, Goodman, Langer & Chick

[57] ABSTRACT

An image forming apparatus having a first mode for image forming at a first recorded pixel density and a second mode for image forming at a second recorded pixel density that is higher than that in the first mode, includes: a selector for selecting either the first mode or the second mode; a fixing unit having a temperature detecting sensor to detect a temperature of the fixing unit; and a controller for changing a temperature condition to be set for the fixing unit in accordance with a change between the first recorded pixel density and the second recorded pixel density selected by the selector. When the first mode is changed to the second mode by the selector, the controller controls to switch the temperature condition of the fixing unit from a temperature condition H1 in the first mode to a temperature condition H2 in the second mode lower than that of the temperature condition H1, provides a predetermined second control temperature h2 between the temperature condition H1 and the temperature condition H2 to control inhibiting or allowing an image forming, and controls to inhibit the image forming when a temperature detected by the sensor is higher than the second control temperature h2, and to allow the image forming when the temperature detected by the sensor is lower than the second control temperature h2.

18 Claims, 10 Drawing Sheets

FIG. 5

| PIXEL DENSITY / IMAGE FORMING CONDITION | 400dpi | 600dpi |
|---|---|---|
| LINEAR SPEED OF PHOTORECEPTOR | 280mm / sec | 125mm / sec |
| NUMBER OF POLYGONAL MIRROR SURFACES | 8 | 8 |
| ROTATIONAL SPEED OF POLYGONAL MIRROR | 16535rpm | 11023rpm |
| CHARGED POTENTIAL OF PHOTORECEPTOR | - 750V | - 750V |
| TOTAL CHARGING CURRENT | 800 $\mu$A | 800 $\mu$A |
| GRID VOLTAGE OF CHARGER | - 710V | - 710V |
| DIAMETER OF DEVELOPING SLEEVE | 40mm | 40mm |
| DEVELOPING BIAS VOLTAGE | - 600V | - 600V |
| ROTATIONAL SPEED OF DEVELOPING SLEEVE | 400rpm | 180rpm |
| ROTATIONAL SPEED OF DEVELOPER STIRRING ROLLER | 250rpm | 250rpm |
| LINEAR SPEED OF FIXING ROLLER | 280mm / sec | 125mm / sec |
| FIXING TEMP. SET | 200℃ | 150℃ |

| 2ND CONTROL TEMP. h2 | WAITING TIME IN SEC. |
|---|---|
| 190℃ | 60 |
| 180℃ | 138 |
| 170℃ | 216 |
| 160℃ | 300 |
| 150℃ | 420 |

FIG. 11

| 2ND CONTROL TEMP. h2 | WAITING TIME IN SEC. |
|---|---|
| 190℃ | 45 |
| 180℃ | 100 |
| 170℃ | 160 |
| 160℃ | 225 |
| 150℃ | 300 |

FIG. 12

| 2ND CONTROL TEMP. h2 | WAITING TIME IN SEC. |
|---|---|
| 190℃ | 11 |
| 180℃ | 23 |
| 170℃ | 35 |
| 160℃ | 47 |
| 150℃ | 60 |

IMAGE FORMING APPARATUS AND CONTROL METHOD THEREOF

BACKGROUND OF THE INVENTION

The present invention relates to an image forming apparatus equipped with an exposure unit of a laser beam type and a fixing unit of a heat roller type and to a control method therefor, and in particular, to an improvement in image forming conducted with plural types of pixel density.

In an image forming apparatus of an electrostatic method equipped with an exposure unit of a laser beam type, an image that is an electrostatic latent image to be formed on a photoreceptor is formed by a combination of primary scanning made by a laser beam and sub-scanning made by a movement of the photoreceptor.

The electrostatic latent image can be recorded with higher density of recorded pixels by reduction of the speed for the sub-scanning, namely by reducing the speed of rotation of the photoreceptor when it is drum-shaped, and thereby by reducing the linear speed of a polygonal mirror or a galvano-mirror. Therefore, a high quality image having high density of pixels can be obtained by switching a density of recorded pixels.

In the case of a fixing unit of a heat roller fixing method, on the other hand, there is usually employed a construction wherein a pair of upper and lower rollers including a heat roller are driven to be rotated in synchronization with the driving speed for a photoreceptor so that they may be synchronized with the conveyance speed for a transfer sheet. Accordingly, when obtaining a high quality image having high density of pixels by switching a density of recorded pixels as stated above, the driving speed for the photoreceptor is switched to the lower speed side, and the driving speed for the paired upper and lower rollers is also lowered simultaneously. When the transferred toner image is fixed by the decelerated paired upper and lower rollers, a period of time for the paired upper and lower rollers to nip the toner image is made long, and pressure and heat which are more than necessary are applied to the toner image accordingly.

This sometimes results in an offset phenomenon wherein toner is excessively fused to be highly adhesive to the surface of a heat roller, and thereby the toner is transferred to stick to the surface of the heat roller, and this toner is transferred again onto a transfer sheet in the following fixing operation to stain the transfer sheet.

Further, when the transfer sheet is ejected after fixing operation and is stacked on an exit tray, it sometimes happens that the toner image formed on a transfer sheet in preceding step of image forming remains uncooled to keep its melted state, and this melted toner sticks to the reverse side of a transfer sheet stacked in the succeeding step to cause a stain on the reverse side of a transfer sheet or sticking of transfer sheets.

Further, there sometimes happens that moisture contained in a transfer sheet is expelled by excessive heating to generate a curl of the transfer sheet, and in the worst case, the transfer sheet can not be separated from the heat roller to stick to the paired upper and lower rollers to be wound around them to cause paper jamming.

As a means for solving the problems mentioned above, Japanese Patent Publication Open to Public Inspection No. 332330/1994 (hereinafter referred to as Japanese Patent O.P.I. Publication) discloses an image forming apparatus wherein a positional relation between a photoreceptor drum and a fixing unit is regulated so that a distance from a separating unit for a transfer sheet provided over the circumferential surface of the photoreceptor drum to a fixing unit may be longer than the maximum length of the transfer sheet to be used, and thereby the transfer sheet separated from the photoreceptor drum is conveyed only by conveyance belt 36, and thereby fixing is conducted by a single temperature set with the driving speed for the fixing unit that is constant independently of change-over of driving speed for the photoreceptor drum.

However, for the purpose of making the distance from a separating unit to a fixing unit to be longer than the maximum length of the transfer sheet, it is necessary to make the depth of the image forming apparatus to be longer, which results in a disadvantage that the apparatus needs to be larger in size.

On the other hand, Japanese Patent O.P.I. Publication No. 72676/1995 discloses a technology wherein, in an image forming apparatus that changes, by switching the driving speed for a photoreceptor, the recorded pixel density of an electrostatic latent image formed on the photoreceptor through exposure made by a laser beam, the image forming apparatus is kept to be unable to operate for copying until a temperature set for a fixing unit provided on the image forming apparatus reaches the temperature corresponding to the driving speed for the fixing unit.

However, a heated heat roller needs a considerably long period of time to be cooled down to the desired temperature set, causing a user to wait for a long time without conducting printing out for that period, resulting in a disadvantage that a working efficiency is extremely lowered. Further, when the image forming operation is controlled to be prohibited or allowed by the temperature set for a fixing unit as in a conventional way, there is caused a problem that the image forming operation is prohibited even for an appropriate fixing temperature when the temperature is in a zone that is higher than the temperature set, despite the image forming under the same image quality mode, because the temperature of the heat roller floats within a temperature range covering both sides higher and lower than the temperature set.

SUMMARY OF THE INVENTION

An object of the invention is to overcome the disadvantages mentioned above, and to realize both an image forming apparatus capable of conducting excellent fixing without causing a long waiting time caused by the control of fixing unit temperature, when conducting image forming under the recorded pixel density for high image quality by means of switching pixel density, and a control method thereof.

Further, in the invention, its object is to realize both an image forming apparatus capable of selecting freely the waiting time, and a control method thereof.

Namely, the invention constituting a means for solving the problems has either one of the following structures (1)–(16).

(1) A first structure is represented by an image forming apparatus having therein a first mode for image forming at the first pixel density and a second mode for image forming at the second pixel density that is higher than that in the first mode, wherein there are provided a selecting means that selects the first mode and the second mode, a fixing unit having a temperature detecting sensor, and a control means that changes the temperature set for the fixing unit in accordance with changes of the first pixel density and the second pixel density made by the selecting means, and the control means switches the temperature set for the fixing unit from high temperature set H1 in the first mode to low temperature H2 in the second mode when the selecting means changes from the first mode to the second mode, and the control means prohibits image forming when the temperature detected by the temperature detecting sensor on the fixing unit is higher than the second control temperature h2 provided on a prescribed basis, to control by prohibiting or allowing the image forming within a range between the temperature set H1 and the temperature set H2, while it allows the image forming when the temperature detected by the temperature detecting sensor is lower than the second control temperature h2.

In the image forming apparatus mentioned above, second control temperature h2 is established in the range between temperature set H1 and temperature set H2, and when the detected heat roller temperature is higher than the second control temperature h2, image forming is prohibited, while when the temperature is lower than the second control temperature h2, image forming is allowed. Thereby, image forming is allowed before the temperature goes down to the temperature set H2, and thus, it is possible to conduct excellent fixing without causing a long waiting time that is resulted from the temperature control for a fixing unit, when conducting image forming under the recorded pixel density for high image quality by switching the pixel density.

(2) The second structure is represented by an image forming apparatus characterized in that a control temperature changing means which changes the second control temperature h2 is provided in the first structure stated above.

In this image forming apparatus in which the second control temperature h2 can be changed, it is possible to conduct excellent fixing without causing a long waiting time that is resulted from the temperature control for a fixing unit and to select the waiting time freely, when conducting image forming under the recorded pixel density for high image quality by switching the pixel density.

(3) The third structure is represented by an image forming apparatus characterized in that the control means can change the control temperature h2 within a range between the temperature set H1 and the temperature set H2 in accordance with an operation from the control temperature changing means mentioned above in the second structure.

A heat roller that is at a temperature higher than temperature set H2 goes down in terms of temperature when the first sheet passes through it, thus, the heat roller comes down to the temperature set H2 more quickly.

In the image forming apparatus mentioned above in which the second control temperature can be changed in accordance with an operation from the control temperature changing means, it is possible to conduct excellent fixing without causing a long waiting time that is resulted from the temperature control for a fixing unit and to select the waiting time freely through operation, when conducting image forming under the recorded pixel density for high image quality by switching the pixel density.

(4) The fourth structure is represented by an image forming apparatus characterized in that the control means controls to drive upper and lower rollers to rotate when the temperature detected by a temperature detection sensor provided on the fixing unit is higher than the second control temperature h2 in the first–third structures.

In the image forming apparatus mentioned above, second control temperature h2 is established in the range between temperature set H1 and temperature set H2, and when the detected temperature is higher than the second control temperature h2, image forming is prohibited, while when the temperature is lower than the second control temperature h2, image forming is allowed. Thereby, image forming is allowed before the temperature goes down to the temperature set H2, and thus, it is possible to conduct excellent fixing without causing a long waiting time that is resulted from the temperature control for a fixing unit, when conducting image forming under the recorded pixel density for high image quality by switching the pixel density.

Furthermore, owing to an arrangement that both upper and lower rollers are rotated, heat is radiated from either one roller at higher temperature to the other roller at lower temperature, realizing considerable drop of temperature and uniform temperature distribution. Therefore, a waiting time is further shortened and excellent fixing can be conducted.

(5) The fifth structure is represented by an image forming apparatus characterized in that a cooling means for cooling the fixing unit is provided and the cooling means is driven by the control means when the temperature is higher than the second control temperature h2 in the first–fourth structures.

In the image forming apparatus mentioned above, second control temperature h2 is established in the range between temperature set H1 and temperature set H2, and when the detected temperature is higher than the second control temperature h2, image forming is prohibited, while when the temperature is lower than the second control temperature h2, image forming is allowed. Thereby, image forming is allowed before the temperature goes down to the temperature set H2, and thus, it is possible to conduct excellent fixing without causing a long waiting time that is resulted from the temperature control for a fixing unit, when conducting image forming under the recorded pixel density for high image quality by switching the pixel density.

Furthermore, driving of the cooling means makes it possible to obtain considerable temperature drop, whereby a waiting time is further shortened and excellent fixing can be conducted.

(6) The sixth structure is represented by an image forming apparatus in the first structure wherein the control means switches the temperature set for the fixing unit from temperature set H2 in the second mode to temperature set H1 in the first mode when the second mode is changed to the first mode by the selecting means, and prescribed first control temperature h1 that controls image forming by prohibiting or allowing within a range between the temperature set H1 and the temperature set H2 is established, whereby, when the temperature detected by a temperature detection sensor on the fixing unit is lower than the first control temperature h1, image forming is prohibited, while when the temperature is higher than the first control temperature, image forming is allowed.

In the image forming apparatus mentioned above, first control temperature h1 is established in the range between temperature set H1 and temperature set H2, and when the detected heater roller temperature is lower than the first control temperature h1, image forming is prohibited, while when the temperature is higher than the first control temperature h1, image forming is allowed. Thereby, image forming is allowed before the temperature goes up to the temperature set H1, and thus, it is possible to conduct excellent fixing without causing a long waiting time that is resulted from the temperature control for a fixing unit, when conducting image forming after returning to the ordinary recorded pixel density.

(7) The seventh structure is represented by an image forming apparatus characterized in that a control temperature changing means which changes the first control temperature h1 is provided in the sixth structure stated above.

In this image forming apparatus in which the first control temperature can be changed, it is possible to conduct excellent fixing without causing a long waiting time that is resulted from the temperature control for a fixing unit and to select the waiting time freely, when conducting image forming after returning to the ordinary recorded pixel density.

The eighth structure is represented by a control method of an image forming apparatus being provided with a fixing unit that has a temperature detection sensor and having therein a first mode for image forming at the first pixel density and a second mode for image forming at the second pixel density that is more dense than that in the first mode, wherein when the first mode is changed to the second mode, the temperature set for the fixing unit is switched from higher temperature set H1 in the first mode to lower temperature set H2 in the second mode, and prescribed second control temperature h2 that controls image forming within a range from the temperature set H1 to the temperature set H2 by prohibiting or allowing the image forming is established to control the image forming by prohibiting it when the temperature detected by the temperature detection sensor in the fixing unit is higher than the second control temperature h2 or by allowing the image forming when the temperature is lower than the second control temperature h2.

In the control method of an image forming apparatus mentioned above, second control temperature h2 is established in the range from temperature set H1 to temperature set H2, and when the detected temperature is higher than the second control temperature h2, image forming is prohibited, while when the temperature is lower than the second control temperature h2, image forming is allowed. Thereby, image forming is allowed before the temperature goes down to the temperature set H2, and thus, it is possible to conduct excellent fixing without causing a long waiting time that is resulted from the temperature control for a fixing unit, when conducting image forming under the recorded pixel density for high image quality by switching the pixel density.

(9) The ninth structure is represented by a control method of an image forming apparatus characterized in that the second control temperature h2 can be changed from the outside in the eighth structure.

In this control method of an image forming apparatus in which the second control temperature can be changed, it is possible to conduct excellent fixing without causing a long waiting time that is resulted from the temperature control for a fixing unit and to select the waiting time freely, when conducting image forming under the recorded pixel density for high image quality by switching the pixel density.

(10) The tenth structure is represented by a control method of an image forming apparatus characterized in that the control for allowing the command for changing the second control temperature h2 within a range from the temperature set H1 to the lower temperature set H2 is carried out in the ninth structure.

In this control method of an image forming apparatus in which the second control temperature can be changed in accordance with operation, it is possible to conduct excellent fixing without causing a long waiting time that is resulted from the temperature control for a fixing unit and to select the waiting time freely through operation, when conducting image forming under the recorded pixel density for high image quality by switching the pixel density.

(11) The eleventh structure is represented by a control method of an image forming apparatus characterized in that there is carried out the control that upper and lower rollers are rotated when the temperature of the fixing unit is higher than the second control temperature h2 in the eighth–tenth structures.

In the image forming apparatus mentioned above, second control temperature h2 is established in the range between temperature set H1 and temperature set H2, and when the detected temperature is higher than the second control temperature h2, image forming is prohibited, while when the temperature is lower than the second control temperature h2, image forming is allowed. Thereby, image forming is allowed before the temperature goes down to the temperature set H2, and thus, it is possible to conduct excellent fixing without causing a long waiting time that is resulted from the temperature control for a fixing unit, when conducting image forming under the recorded pixel density for high image quality by switching the pixel density.

Furthermore, owing to an arrangement that both upper and lower rollers are rotated, heat is radiated from either one roller at higher temperature to the other roller at lower temperature, realizing considerable temperature drop and uniform temperature distribution. Therefore, a waiting time is further shortened and excellent fixing can be conducted.

(12) The twelfth structure is represented by a control method of an image forming apparatus characterized in that the fixing unit is cooled when the temperature of the fixing unit is higher than the second control temperature h2 in the eleventh structure.

In the control method of an image forming apparatus mentioned above, second control temperature h2 is established in the range between temperature set H1 and temperature set H2, and when the detected temperature is higher than the second control temperature h2, image forming is prohibited, while when the temperature is lower than the second control temperature h2, image forming is allowed. Thereby, image forming is allowed before the temperature goes down to the temperature set H2, and thus, it is possible to conduct excellent fixing without causing a long waiting time that is resulted from the temperature control for a fixing unit, when conducting image forming under the recorded pixel density for high image quality by switching the pixel density.

When the fixing unit is further cooled, considerable drop of temperature is realized and waiting time is further shortened, and excellent fixing can be conducted.

(13) The thirteenth structure is represented by a control method of an image forming apparatus in the eighth structure wherein the temperature set for the fixing unit is switched from temperature set H2 in the second mode to temperature set H1 in the first mode when the second mode is changed to the first mode by the selecting means, and prescribed first control temperature h1 that controls image forming by prohibiting or allowing within a range between the temperature set H1 and the temperature set H2 is established, whereby, when the temperature detected by a temperature detection sensor on the fixing unit is lower than the first control temperature h1, image forming is prohibited, while when the temperature is higher than the first control temperature, image forming is allowed.

In the control method of an image forming apparatus mentioned above, first control temperature h1 is established in the range between temperature set H1 and temperature set H2, and when the detected temperature is lower than the first control temperature h1, image forming is prohibited, while when the temperature is higher than the first control temperature h1, image forming is allowed. Thereby, image forming is allowed before the temperature goes up to the temperature set H1, and thus, it is possible to conduct excellent fixing without causing a long waiting time that is resulted from the temperature control for a fixing unit, when conducting image forming after returning to the ordinary recorded pixel density.

(14) The fourteenth structure is represented by a control method of an image forming apparatus characterized in that the first control temperature h1 can be changed from the outside in the thirteenth structure.

In this control method of an image forming apparatus in which the first control temperature can be changed, it is possible to conduct excellent fixing without causing a long waiting time that is resulted from the temperature control for a fixing unit and to select the waiting time freely, when conducting image forming after returning to the ordinary recorded pixel density.

(15) The fifteenth structure is represented by a control method of an image forming apparatus in the eighth structure wherein aforesaid second control temperature h2 is established to be within a range from a temperature higher than the temperature set H2 by 5° C. to a temperature lower than the temperature set H1 by 5° C.

In the control method of an image forming apparatus mentioned above wherein the second control temperature h2 is selected to be within a range from a temperature higher than the temperature set H2 by 5° C. to a temperature lower than the temperature set H1 by 5° C., it is possible to conduct excellent fixing without causing a long waiting time that is resulted from the temperature control for a fixing unit, when conducting image forming under the recorded pixel density for high image quality by switching the pixel density.

(16) The sixteenth structure is represented by a control method of an image forming apparatus in the thirteenth structure wherein aforesaid first control temperature h1 is established to be within a range from a temperature higher than the temperature set H2 by 5° C. to a temperature lower than the temperature set H1 by 5° C.

In the control method of an image forming apparatus mentioned above wherein the first control temperature h1 is selected to be in a range from a temperature higher than the temperature set H2 by 5° C. to a temperature lower than the temperature set H1 by 5° C., it is possible to conduct excellent fixing without causing a long waiting time that is resulted from the temperature control for a fixing unit, when conducting image forming after returning to the ordinary recorded pixel density.

BRIEF DESCRIPTION OF THE DRAWINGS

FIG. 5 is a table of characteristics showing an example of image forming conditions following the switching of pixel density in an embodiment of the invention.

FIG. 11 is a table of characteristics showing the relation between establishment of second control temperature h2 and waiting time following the switching of pixel density in an embodiment of the invention.

FIG. 12 is a table of characteristics showing the relation between establishment of second control temperature h2 and waiting time following the switching of pixel density in an embodiment of the invention.

DETAILED DESCRIPTION OF THE PREFERRED EMBODIMENT

Figure 1:
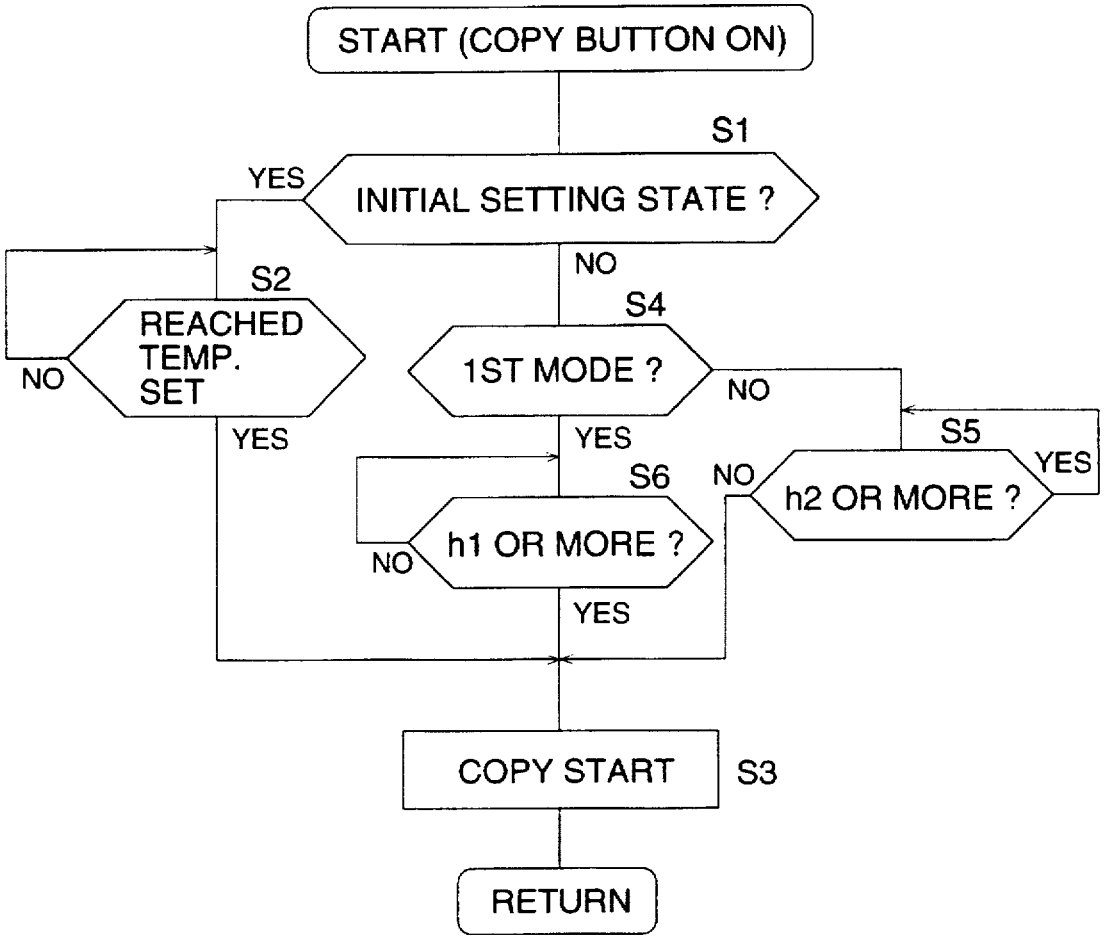
FIG. 1 is a flow chart showing processing procedures for fixing temperature control that follows the switching of pixel density in an embodiment of the invention.

An image forming apparatus and a control method thereof of the invention will be explained as follows, referring to the drawings.

Mechanical Structure

Here, an overall mechanical structure of an image forming apparatus used in an embodiment of the invention will be explained first, referring to FIG. 2.

Figure 2:
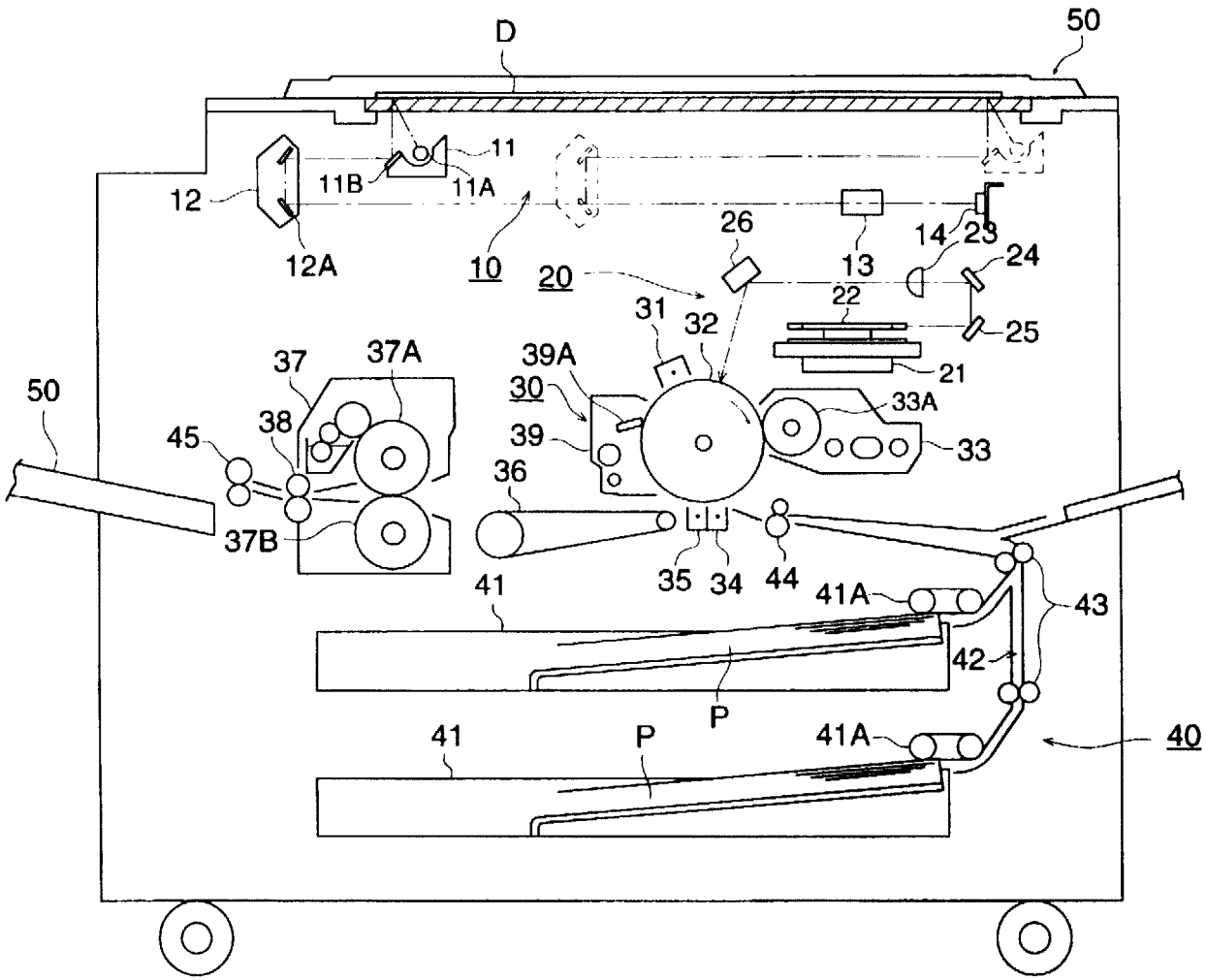
FIG. 2 is a sectional view showing the mechanical section structure of an image forming apparatus used in the embodiment of the invention.

FIG. 2 is a sectional view of an image forming apparatus of the invention, wherein the apparatus is composed of image reading section 10, laser-writing section 20, image forming section 30 and sheet feeding section 40.

An image of original D placed on an original stand is subjected to exposure scanning conducted by a parallel movement of first mirror unit 11 equipped with illumination lamp 11A and mirror 11B both in image reading section 10 from its position shown with solid lines to its position shown with broken lines and conducted by a movement of second mirror unit 12 equipped with paired mirrors 11B facing to each other to follow the first mirror unit 11 at the speed which is a half of that of the first mirror unit. Then, the image obtained through the exposure scanning is formed on image-pickup element 14 through photographing lens 13, and then is stored momentarily in a memory as an image signal after being subjected to image processing.

Then, the image signal is read out of the memory, and is inputted into laser-writing section 20, upon which a laser beam generated by a semi-conductor laser is subjected to rotary scanning made by polygonal mirror 22 that is rotated by driving motor 21.

The laser beam projected is reflected on a rotating surface of the polygonal mirror 22 for scanning, then it passes through fθ lens 23 and a cylindrical lens, and scans the photoconductive surface of photoreceptor drum 32 charged by charging unit 31 in advance, for scanning exposure. This scanning exposure forms an electrostatic latent image of the original image on the photoconductive surface of the photoreceptor drum 32. Thus, the electrostatic latent image of the original image is formed on the circumferential surface of the photoreceptor drum 32 by both primary scanning made by a laser beam and sub-scanning made by rotation of the photoreceptor drum 32. This electrostatic latent image is subjected to reversal development by developing agents held on developing sleeve 33A of developing unit 33 to be turned into a toner image.

On the other hand, transfer sheet P in a designated size is fed out of sheet cassette 41 loaded in sheet feeding section 40 by an action of feed-out roller 41A of the sheet cassette 41, and then is conveyed toward an image transfer section through conveyance roller 43.

The transfer sheet P thus fed out is adjusted in terms of timing with the toner image on the circumferential surface of the photoreceptor drum 32 by registration roller 44, and then is conveyed, in synchronization with the toner image, to the transfer section where the toner image is charged by transfer unit 34 and is transferred onto the transfer sheet.

After that, the transfer sheet P is separated from the circumferential surface of the photoreceptor drum 32 by the neutralizing operation of separating unit 35, then is conveyed by conveyance belt 36 to fixing unit 37 where the transfer sheet is sandwiched by upper roller 37A and lower roller 37B to be given heat and pressure which fuse and fix the toner. After that, the transfer sheet is ejected out of the fixing unit 37 by conveyance roller 38.

Figure 3:
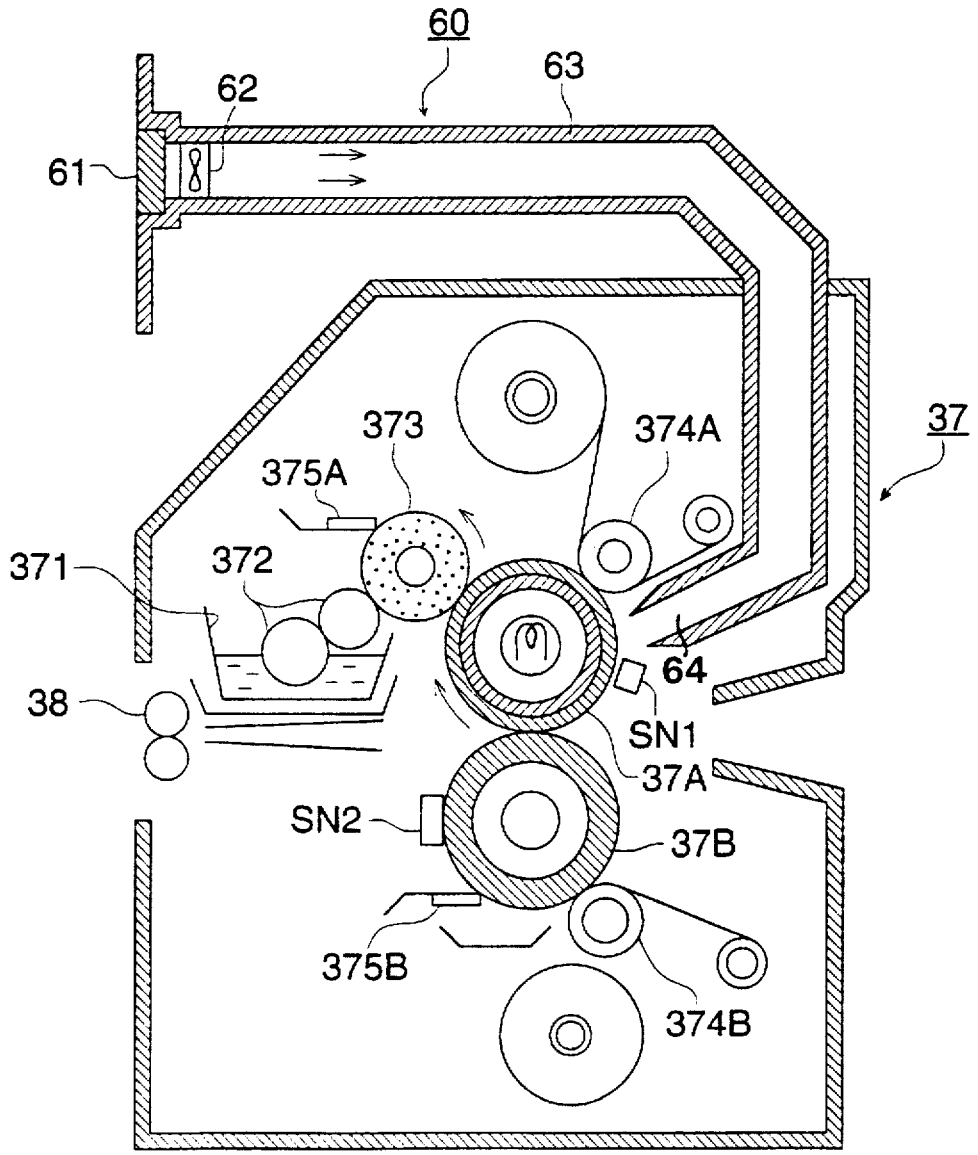
FIG. 3 is a sectional view showing the sectional structure of a fixing unit used in the embodiment of the invention.

The fixing unit 37 is of a structure shown in FIG. 3, and upper roller 37A out of a pair of upper roller 37A and lower roller 37B is a heat roller. Sponge-like coating roller 373 into which silicone oil in oil pan 371 is impregnated through supply roller 372 is constantly in pressure contact with the circumferential surface of the upper roller 37A. Namely, when the coating roller 373 is rotated counterclockwise against the rotation of the upper roller 37A, silicone oil can be coated evenly on the circumferential surface of the upper roller 37A as a releasing agent, thus, occurrence of the so-called offset phenomenon that fused toner on the transfer sheet P is moved to the circumferential surface of the upper roller 37A can be prevented.

A circumferential surface of the upper roller 37A and that of the coating roller 373 are cleaned respectively by cleaning web 374A and cleaning blade 375A, and a circumferential surface of the lower roller 37B is constantly kept to be clean by pressure contact therewith of cleaning web 374B and cleaning blade 375B. The upper roller 37A and lower roller 37B are subjected to temperature detection respectively by temperature sensor SN1 and temperature sensor SN2, and prescribed temperatures established are maintained through temperature control described later.

Incidentally, the fixing unit 37 is provided with cooling unit 60 so that the returning to the temperature set may be performed quickly, and an arrangement is made so that air from which foreign materials have been removed by filter 61 is sucked into duct 63 by fan 62 to be ejected out of outlet 64 to cool the upper roller 37A and the whole internal portion of the fixing unit 37.

Transfer sheet P ejected out of the fixing unit 37 is delivered on tray 50 through sheet exit roller 45.

On the other hand, photoreceptor drum 32 from which the transfer sheet P has been separated is cleaned by blade 39A that is in pressure contact with the photoreceptor drum in cleaning unit 39, to be free from residual toner, and then is charged again by charging unit 31 to be ready for the succeeding process of image forming.

Electrical Structure

The image forming apparatus structured in the manner mentioned above is of an electrical structure shown in FIG. 4.

Namely, the image forming apparatus is equipped with operation section 70 on which various operations, instructions and selections are made, CPU 71 that receives instructions from the operation section 70 and controls the image forming apparatus entirely, and display section 72 which displays information about operations of the image forming apparatus.

It is further arranged so that photoreceptor drive section 32M that drives the photoreceptor drum 32, conveyance unit drive section 36M that drives the conveyance belt, charging unit control section 31C that drives the charging unit 31 and developing unit drive section 33M that drives the developing unit 33 may be controlled by CPU 71.

The fixing unit 37 is equipped with fixing temperature control section 37C that controls a fixing temperature. On this fixing temperature control section 37C, there are provided sensor SN1 that detects a temperature of the upper roller 37A, SN2 that detects a temperature of the lower roller 37B, heater 37H that heats the upper roller 37A and lower roller 37B, and cooler 60 that cools the inside of the fixing unit 37. Fixing unit drive section 37M that drives the upper roller 37A and lower roller 37B for rotation executes the driving in accordance with instructions from CPU 71 and the fixing temperature control section 37C.

Pixel Density Switching Operation

The operation section 70 is provided with a pixel density selecting means which can switch the recorded pixel density of an electrostatic latent image formed on photoreceptor drum 32 either to the first mode for image forming at ordinary 400 dpi (400 dots per 1 inch length), for example, or to the second mode for image forming at the pixel density of 600 dpi.

The switching of pixel density mentioned above is realized when CPU 71 gives 400/600 dpi switching signals to various sections based on signals from the operation section 70 that is equipped with the selecting means.

Namely, the photoreceptor drive section 32M which has received switching signals from CPU 71 reduces the rotational speed of the photoreceptor drum 32. Further, the writing unit drive section 20M which has received switching signals from CPU 71 reduces the linear speed of the polygonal mirror 22. The switching of pixel density is realized when image forming conditions of the relevant image forming members are corrected for adaptation.

When the recorded pixel density is set to ordinary 400 dpi without being switched, the driving speed for the photoreceptor drum 32 and its related image forming conditions are set to characteristic values shown in a column of 400 dpi in FIG. 5.

Further, when the pixel density is switched from ordinary 400 dpi to high quality 600 dpi, the driving speed for the photoreceptor drum 32 and its related image forming conditions are changed to be set to characteristic values shown in a column of 600 dpi in FIG. 5.

Figure 4:
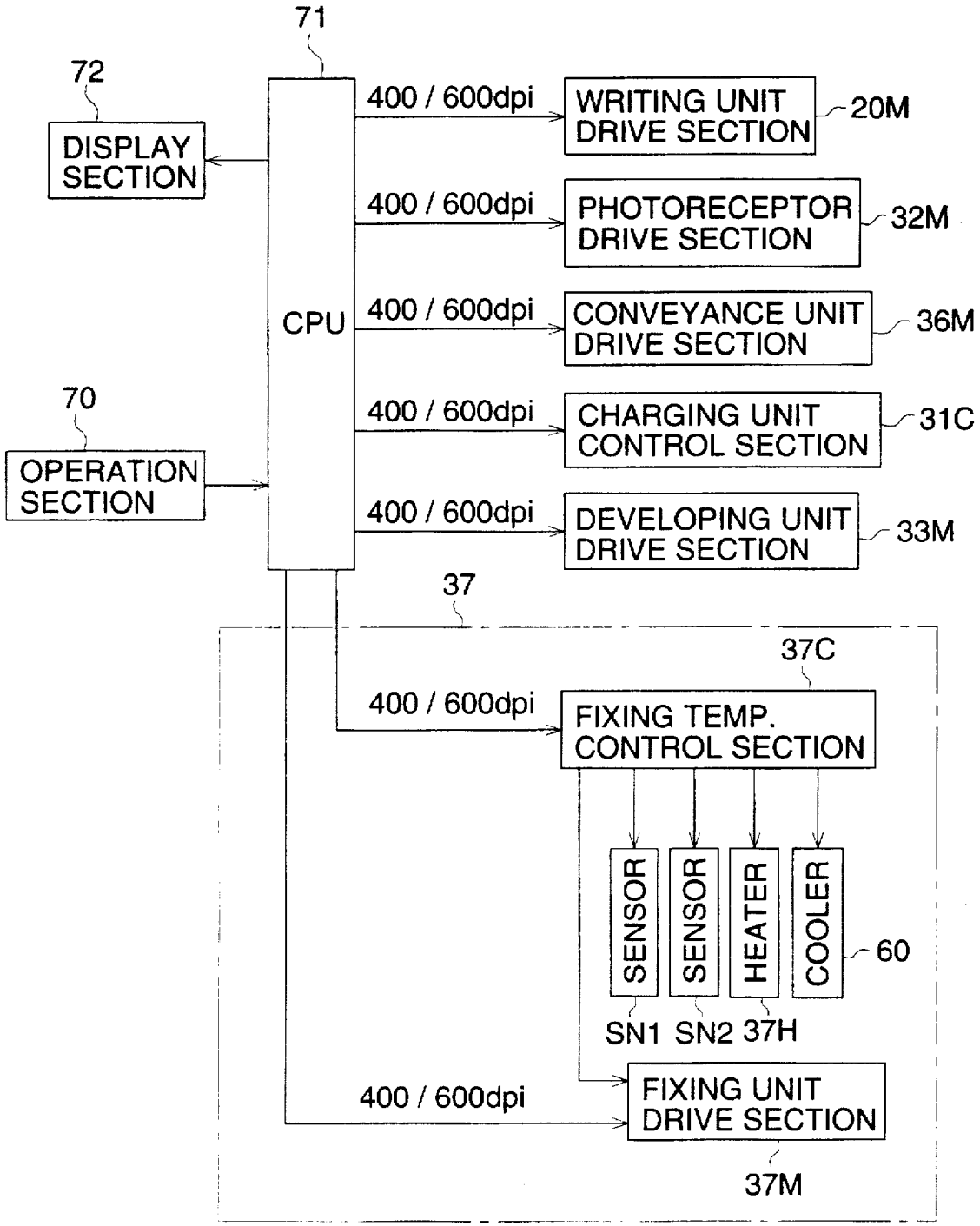
FIG. 4 is a structural diagram showing, by functional block, the electrical structure of an image forming apparatus used in the embodiment of the invention.

When the recorded pixel density is switched, driving for the photoreceptor drum 32, rotation driving for the polygonal mirror 22, driving for developing unit 33, conveyance speed for transfer sheet P, driving for the fixing unit 37 and voltage of high voltage power supply are switched simultaneously to the values shown in FIG. 5 by 400/600 dpi switching signals from CPU 71, as shown in FIG. 4. When driving for the fixing unit 37 is switched, driving for the coating roller 373 is also switched simultaneously.

As an example, when the recorded pixel density is switched from the first mode of 400 dpi wherein the linear speed of both the upper roller 37A and coating roller 373 is 280 mm/sec. to the second mode of 600 dpi, it is possible to increase an amount of oil to be supplied to transfer sheet in A4 size, by about 10 times, from 1–2 mg to 10–15 mg and thereby to improve the releasing property, by reducing the linear speed of the upper roller 37A to 125 mm/sec. in accordance with the linear speed of the photoreceptor drum 32 and by increasing the linear speed of coating roller 373 to 150 mm/sec.

When the first mode of 400 dpi of recorded pixel density is switched to the second mode of 600 dpi, for example, in the invention, a linear speed of photoreceptor drum 32 is reduced from 280 mm/sec. to 125 mm/sec., a rotational speed of polygonal mirror 22 is reduced from 16,535 r.p.m. to 11,023 r.p.m., and a rotational speed of developing sleeve 33A is reduced from 400 r.p.m. to 180 r.p.m., as shown in the column of "600 dpi" of Table 1, and further, a conveyance speed for transfer sheet P and a driving speed for fixing unit 37 are also reduced for synchronization with the foregoing.

In experiments made by the inventors of the invention for forming an appropriate fixed image for each recorded pixel density, there were used a fixing unit and a developing agent having respectively the specifications shown below.

(Fixing unit)

Upper roller: 324 mm in length, 50 mm in diameter Φ

Material of core metal A5056TD (PFA coat 20 μm)

Lower roller 310 mm in length, 50 mm in diameter Φ

Material of core metal STKM (LTV rubber 5 mm . . . Rubber hardness 30°+PFA tube)

Load for pressure contact: 3.7 kgf/cm$^2$

Heater: Upper roller=1100 W, Lower roller=200 W

Temperature to be set for fixing: 200° C. (Upper roller)

(Developing agent)

Toner: Polyester type; Average grain size 8.5 μm

Carrier: Resin-coated ferrite; Average grain size 60 μm

Toner density: 6%

Through switching of recorded pixel density, a temperature set for fixing unit 37 is changed so that an amount of heat generated from heater H housed in upper roller 37A may be controlled for appropriate fixing operation which is stable and excellent in terms of efficiency.

Temperature H1 and temperature H2 to be set respectively for fixing unit 37 are set to 200° C. in the case of the first mode wherein recorded pixel density for both upper roller 37A and lower roller 37B is 400 dpi, and they are set to 150° C. in the case of the second mode of 600 dpi, and that temperature is detected by temperature detection sensors SN1 and SN2 provided respectively on the circumferential surfaces of the upper roller 37A and the lower roller 37B.

<Processing Procedures in Pixel Density Switching Operation>

Now, processing procedures in operation of switching pixel density will be explained in detail as follows, referring to flow charts in FIG. 1 and thereafter.

Let it be assumed that H1 represents the temperature to be set for fixing unit 37 in the case of the first mode (ordinary mode) for forming images with recorded pixel density of 400 dpi, and h1 represents the first control temperature for prohibiting and allowing image forming operations.

Let it be assumed that H2 represents the temperature to be set for fixing unit 37 in the case of the second mode (high image quality mode) for forming images with recorded pixel density of 600 dpi, and h2 represents the second control temperature for prohibiting and allowing image forming operations.

With regard to the temperature set H1, the temperature set H2, the first control temperature h1 and the second control temperature h2, it is preferable that they are stored in a table or a register in fixing temperature control section 37C based on instructions of CPU 71.

Incidentally, the temperature H1 is one which is suitable for ordinary fixing, while H2 is one which is suitable for fixing at the conveyance speed for forming images of high image quality. For example, for ordinary image forming at 400 dpi, H1 is 200° C., and for image forming at 600 dpi for high image quality, H2 is 150° C.

Further, prescribed second control temperature h2 which controls to prohibit or allow the image forming in the second mode is provided, and prescribed first control temperature h1 which controls to prohibit or allow the image forming in the first mode is provided, both in a range from the temperature set H1 to the temperature set H2.

When setting is made as in the foregoing, an image forming operation in each mode is controlled by a control system as shown in the flow chart in FIG. 1. Incidentally, this processing shown in FIG. 1 is conducted as a sub-routine at regular intervals, or when an input by means of operation section 72 is made.

<Operation 1>

Namely, CPU 71 conducts the control wherein a state is checked whether it is the initial setting state such as the moment when power supply is turned on or not (S1 in FIG. 1), and when it is in the initial setting state, UNDER PREPARATION is kept to be displayed on display section 72 and image forming operations are prohibited until the moment when the temperature detected by temperature detection sensor SN1 provided on the upper roller 37A reaches the temperature set H1 or H2 corresponding to the selected first mode or to the selected second mode (S2 in FIG. 1). When the detected temperature reaches the temperature set H1 or H2, OPERATION READY is displayed on display section 72, and operations for image forming are made possible to be started (S3 in FIG. 1).

Incidentally, the display of UNDER PREPARATION and that of OPERATION READY can be represented by turning off or turning on of a READY lamp.

The reason for the foregoing is as follows. In the initial setting state immediately after the moment when power supply is turned on, upper roller 37A and lower roller 37B have not been heated up to the sufficiently stable temperature state. For preventing insufficient fixing, therefore, it is necessary to heat them once up to the temperature set.

Further, when the recorded pixel density is switched from the first mode to the second mode (S1, S4 in FIG. 1), CPU 71 makes temperature detection sensor SN1 to check whether or not the fixing roller 37A is at the prescribed second control temperature h2 or more (S5 in FIG. 1).

Namely, CPU 71 conducts the control wherein when the first mode is changed to the second mode and the temperature detected by the temperature detection sensor SN1 is the second control temperature h2 or more, UNDER PREPARATION is displayed on display section 72 and image forming operations are prohibited for preventing insufficient fixing caused by the re-transfer of toner (S5 in FIG. 1), and at the moment when the temperature becomes lower than the second control temperature h2 through natural cooling (natural heat radiation), OPERATION READY is displayed on display section 72, and operations for image forming are made possible to be started (S3 in FIG. 1).

Incidentally, the display of UNDER PREPARATION and that of OPERATION READY can be represented by turning off or turning on of a READY lamp.

As stated above, when the first mode is changed to the second mode, the temperature set for the fixing unit is switched from higher temperature set H1 in the first mode to lower temperature set H2 in the second mode, prescribed second control temperature h2 which controls to prohibit or allow the image forming is provided in a range from the temperature set H1 to the temperature set H2, and there is made control wherein image forming is prohibited when the heat roller temperature detected by a temperature detection sensor of the fixing unit is higher than the second control temperature h2, while the image forming is allowed when that temperature is lower than the second control temperature h2. Thereby, the image forming is allowed before the heat roller temperature goes down to the temperature set, and thus, it is possible to conduct excellent fixing without causing a long waiting time that is resulted from the temperature control for the fixing unit, when conducting image forming with recorded pixel density for high image quality after switching the pixel density.

Incidentally, even when image forming is allowed by the second control temperature h2, no problem is caused in particular, because the heat roller temperature can be lowered also by the phenomenon that heat is absorbed by transfer sheet P in execution of image forming.

Incidentally, in the operation 1 mentioned above, it is considered that an arrangement is made so that the second control temperature h2 stored in fixing temperature control section 37C may be changed by instructions from CPU 71. Namely, CPU 71 constitutes a control temperature changing means in this case.

In an image forming apparatus structured in the above-mentioned manner, it is possible to change the second control temperature. Therefore, it is possible to conduct excellent fixing without causing a long waiting time that is resulted from the temperature control for a fixing unit, and to select the waiting time freely, when conducting image forming with recorded pixel density for high image quality after switching of pixel density.

Further, it is also possible to arrange so that the second control temperature h2 may be changed by operations from operation section 70 in place of being changed by instructions from CPU 71 as stated above.

Even in the case of the arrangement mentioned above, it is possible to conduct excellent fixing without causing a long waiting time that is resulted from the temperature control for a fixing unit, and to select the waiting time freely through operations.

Figure 6:
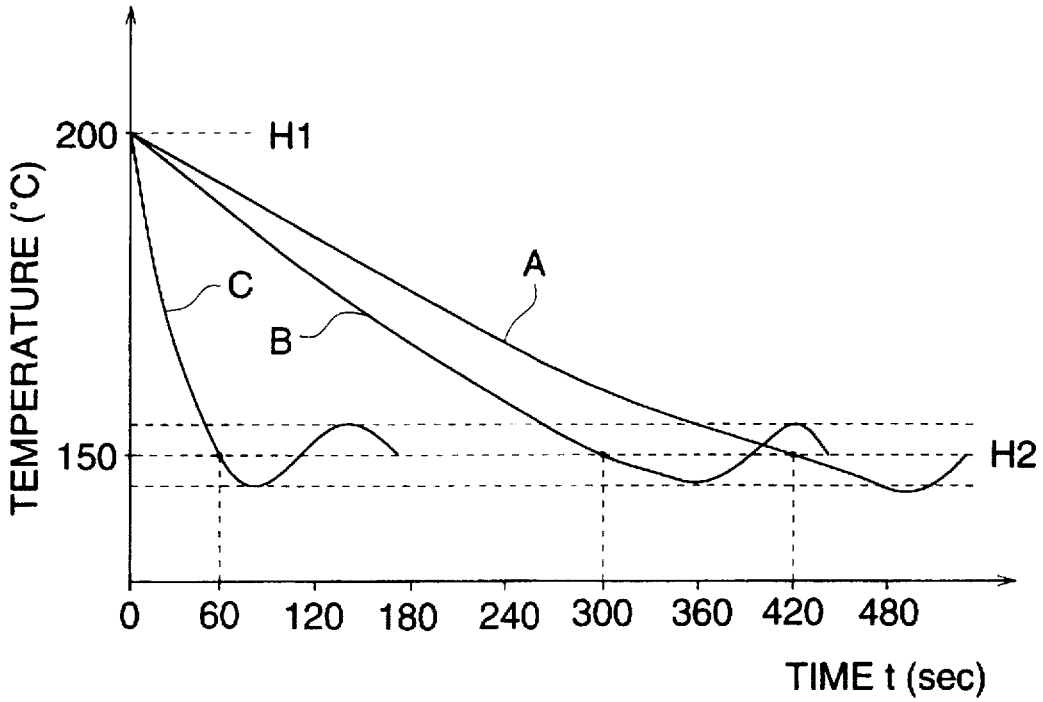
FIG. 6 is a diagram of characteristics showing temperature control for a heat roller following the switching of pixel density in an embodiment of the invention.

FIG. 6 is a diagram of characteristics showing the behavior of a temperature of a heat roller (upper roller 37A). In this case, temperature set H1 in the first mode for ordinary pixel density (e.g., 200° C.) and temperature set H2 in the second mode for high image quality (e.g., 150° C.) are set. Incidentally, with regard to the temperatures set H1 and H2, each of them is controlled through turning on/turning off of a heater within a range from about +5° C. to about −5° C. both against a center value of the temperature set (upper limit and lower limit).

In such a case, pixel density is switched at time t0, and temperature set is switched from H1 to H2. Incidentally, temperature control having temperature set H1 before time t0 as a center is not illustrated.

Characteristic curve A represents temperature characteristics caused by natural cooling in the present embodiment. Though image forming has been allowed at the moment when the heat roller temperature reaches H2 (420 seconds later) in the past, image forming in the present embodiment can be allowed in a shorter period of time by setting the second control temperature h2 to be higher than the temperature set H2. For example, image forming is allowed after about 210 seconds when the second control temperature h2 is set to 170° C.

Incidentally, when the second control temperature h2 is changed, the time to wait until the moment when image forming is allowed is also changed.

<Operation 2>

Figure 7:
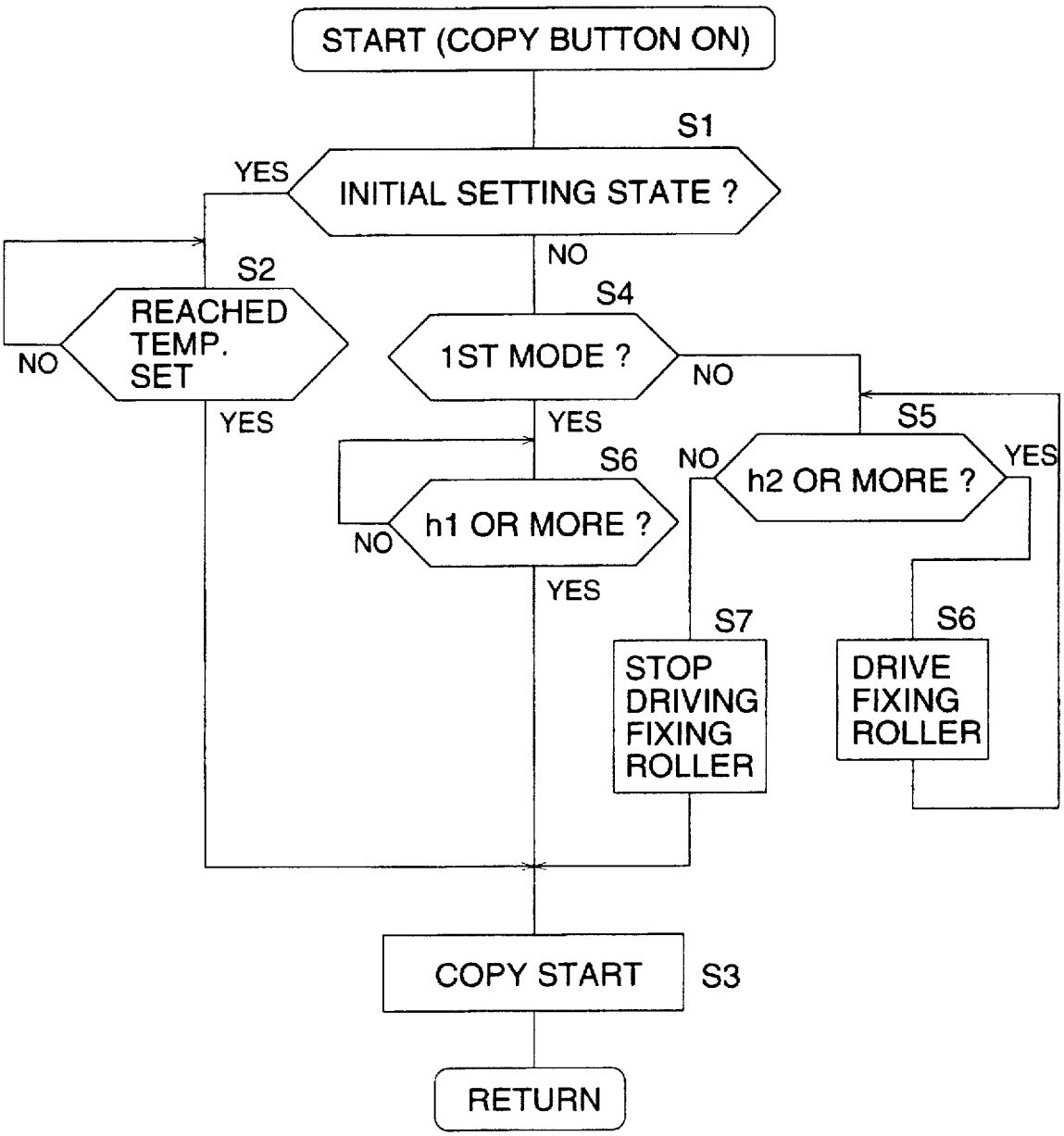
FIG. 7 is a flow chart showing processing procedures for fixing temperature control following the switching of pixel density in an embodiment of the invention.

FIG. 7 shows processing procedures for the second control in the image forming apparatus mentioned above. Namely, when the first mode is changed to the second mode, the control wherein the heat roller temperature detected is not less than the control temperature h2 is different from the first control shown in FIG. 1.

In the present embodiment, fixing temperature control section 37C controls to rotate an upper roller and a lower roller (S6 in FIG. 7) when the temperature of upper roller 37A (heat roller) detected by sensor SN1 is higher than the second control temperature h2, and when the temperature reaches the second control temperature h2, the rotations of the upper and lower rollers are stopped (S7 in FIG. 7).

Namely, by keeping upper roller 37A and lower roller 37B both of fixing unit 37 under the state of being driven simultaneously with the change in temperature set (H1: 200° C.→H2: 150° C.), it is possible to lower the temperature of the upper roller through its rotation in contact with the lower roller 37B that is lower in temperature, and to lower efficiently the temperature of each of upper and lower rollers through heat radiation effect on the circumferential surface of the roller caused by its rotation.

In experiments, when temperature set H1 of 200° C. of an upper roller in the first mode is cooled down to temperature set H2 of 150° C. in the second mode by switching to the second mode, overall average temperature drop rate was 0.12° C./sec. and temperature distribution in the axial direction of the roller was uneven when each roller was not rotated and was subjected to natural cooling, while when the upper roller 37A and the lower roller 37B were kept to be rotating, the temperature drop rate (overall average) of 0.17° C./sec. was obtained. In addition, it was confirmed that the temperature distribution was uniform, because heat was distributed over the total surface of the upper roller.

Accordingly, image forming can be allowed in a short period of time as shown on characteristic curve B in FIG. 6. For example, when the second control temperature is selected to be 170° C., image forming is allowed in about 160° C.

Incidentally, this heat radiation by means of roller rotation is based on a temperature difference between the upper roller and the lower roller. Therefore, it sometimes happens that the rate of temperature drop is great in the initial stage and it is gradually lowered. In addition, it sometimes happens that a value of the rate of temperature drop is different from the value in the above-mentioned experiment due to an effect of the temperature of the lower roller 37B which is low in temperature.

<Operation 3>

Figure 8:
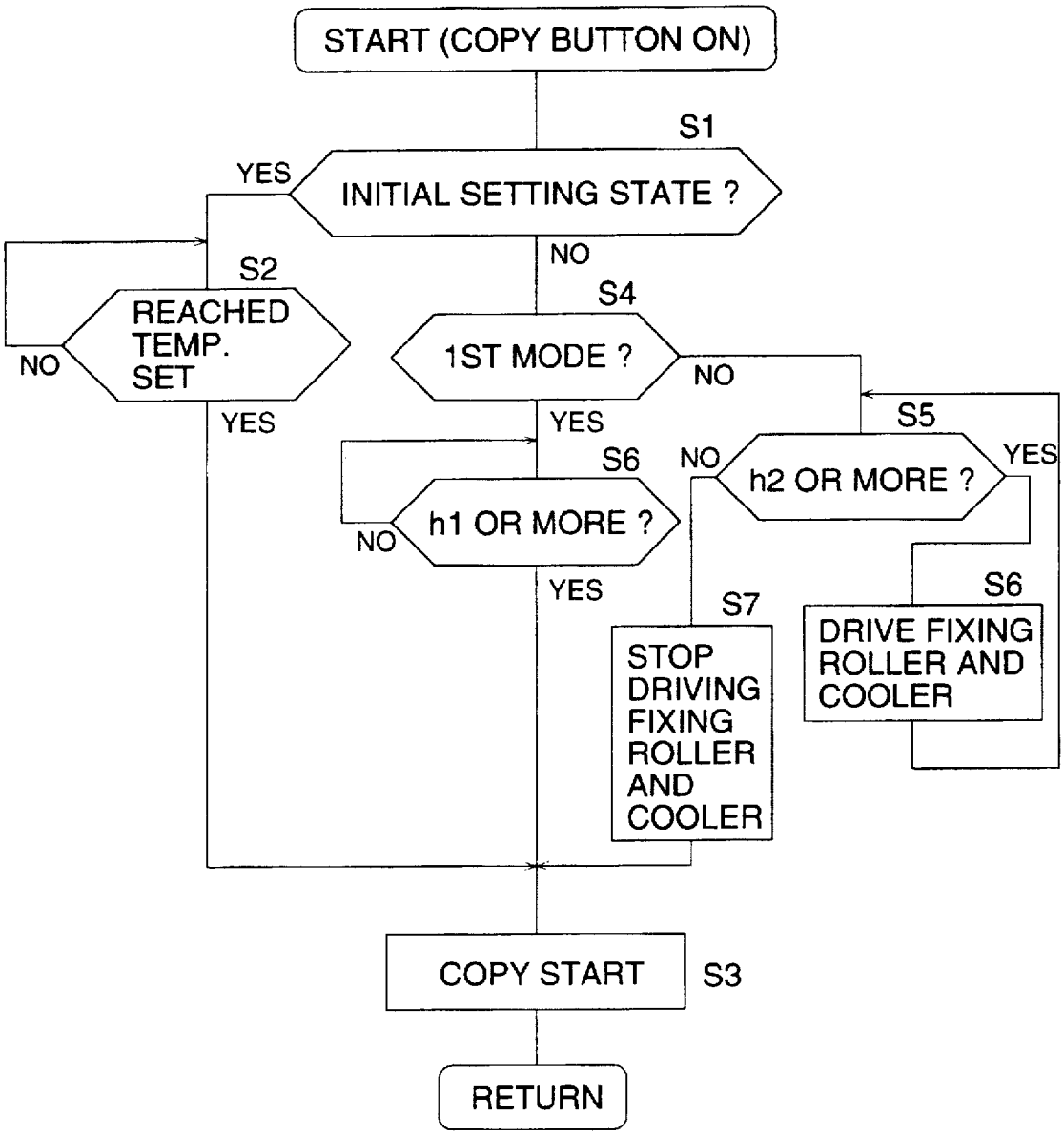
FIG. 8 is a flow chart showing processing procedures for fixing temperature control following the switching of pixel density in an embodiment of the invention.

FIG. 8 shows processing procedures of the third control in the image forming apparatus mentioned above. Namely, in the case of switching from the first mode to the second mode, the control in the case where the detected temperature of a heat roller is not lower than control temperature h2 is different from that mentioned above.

In the present embodiment, fixing temperature control section 37C controls so that both upper and lower rollers are driven to rotate and cooling unit 60 is operated (S6 in FIG. 8) when the temperature of a heat roller detected by sensor SN1 is higher than the second control temperature h2, and the fixing temperature control section 37C stops driving the cooling unit 60 and stops driving the upper and lower rollers to rotate (S7 in FIG. 8) when the temperature of the heat roller reaches the second control temperature h2.

Namely, the upper roller 37A and the lower roller 37B of fixing unit 37 are put in their state of operation simultaneously with a change in temperature set (H1: 200° C.→H2: 150° C.), whereby fan 62 of cooling unit 60 is driven to send air from air outlet 64 through duct 63 to cool the upper roller 37A, the lower roller 37B and the whole inner part of the fixing unit 37.

In the experiment, the temperature drop rate of 0.84° C./sec. was obtained as an overall average value, by driving cooling unit 60. Accordingly, image forming can be allowed in an extremely short period of time (approx. 50 seconds) as shown in characteristic curve C in FIG. 6.

Namely, the temperature in each of upper and lower rollers can be lowered efficiently in a short period of time by temperature drop of the upper roller caused by contact rotation of the lower roller 37B whose temperature is low and by heat radiation on the circumferential surface of the roller caused by its rotation as well as by forced cooling.

Incidentally, this heat radiation by means of roller rotation is based on a temperature difference between the upper roller and the lower roller and on air cooling. Therefore, it sometimes happens that the rate of temperature drop is great in the initial stage and it is gradually lowered. In addition, it sometimes happens that a value of the rate of temperature drop is different from the value in the above-mentioned experiment due to an effect of the temperature of the lower roller 37B which is low in temperature and to ambient temperature in the case of air cooling.

<Operation 4>

Further, when the recorded pixel density is switched from the second mode to the first mode (S1, S4 in FIG. 1), CPU 71 makes temperature detection sensor SN1 to check whether or not the fixing roller 37A is at the prescribed first control temperature h1 or more (S6 in FIG. 1).

Namely, CPU 71 conducts the control wherein when the second mode is changed to the first mode and the temperature detected by the temperature detection sensor SN1 is not higher than the first control temperature h1, UNDER PREPARATION is displayed on display section 72 and image forming operations are prohibited for preventing insufficient fixing caused by the low temperature (S6 in FIG. 1), and at the moment when the temperature becomes to be not lower than the first control temperature h1, OPERATION READY is displayed on display section 72, and operations for image forming are made possible to be started (S3 in FIG. 1).

Incidentally, the display of UNDER PREPARATION and that of OPERATION READY can be represented by turning off or turning on of a READY lamp.

As stated above, when the second mode is changed to the first mode, the temperature set for the fixing unit is switched from lower temperature set H2 in the second mode to higher temperature set H1 in the first mode, prescribed first control temperature h1 which controls to prohibit or allow the image forming is provided in a range from the temperature set H2 to the temperature set H1, and there is made control wherein image forming is prohibited when the heat roller temperature detected by a temperature detection sensor of the fixing unit is lower than the first control temperature h1, while the image forming is allowed when that temperature is not lower than the first control temperature h1. Thereby, the image forming is allowed before the heat roller temperature reaches the temperature set H1, and thus, it is possible to conduct excellent fixing without causing a long waiting time that is resulted from the temperature control for the fixing unit, when conducting image forming after returning the pixel density to an ordinary level.

Incidentally, in the operation 4 mentioned above, it is considered that an arrangement is made so that the first control temperature h1 stored in fixing temperature control section 37C may be changed by instructions from CPU 71. Namely, CPU 71 constitutes a control temperature changing means in this case.

In an image forming apparatus structured in the above-mentioned manner, it is possible to change the first control temperature. Therefore, it is possible to conduct excellent fixing without causing a long waiting time that is resulted from the temperature control for a fixing unit, and to select the waiting time freely, when conducting image forming with ordinary recorded pixel density after switching of pixel density.

Further, it is also possible to arrange so that the first control temperature h1 may be changed by operations from operation section 70 in place of being changed by instructions from CPU 71 as stated above.

Even in the case of the arrangement mentioned above, it is possible to conduct excellent fixing without causing a long waiting time that is resulted from the temperature control for a fixing unit, and to select the waiting time freely through operations.

Figures 9, 10:
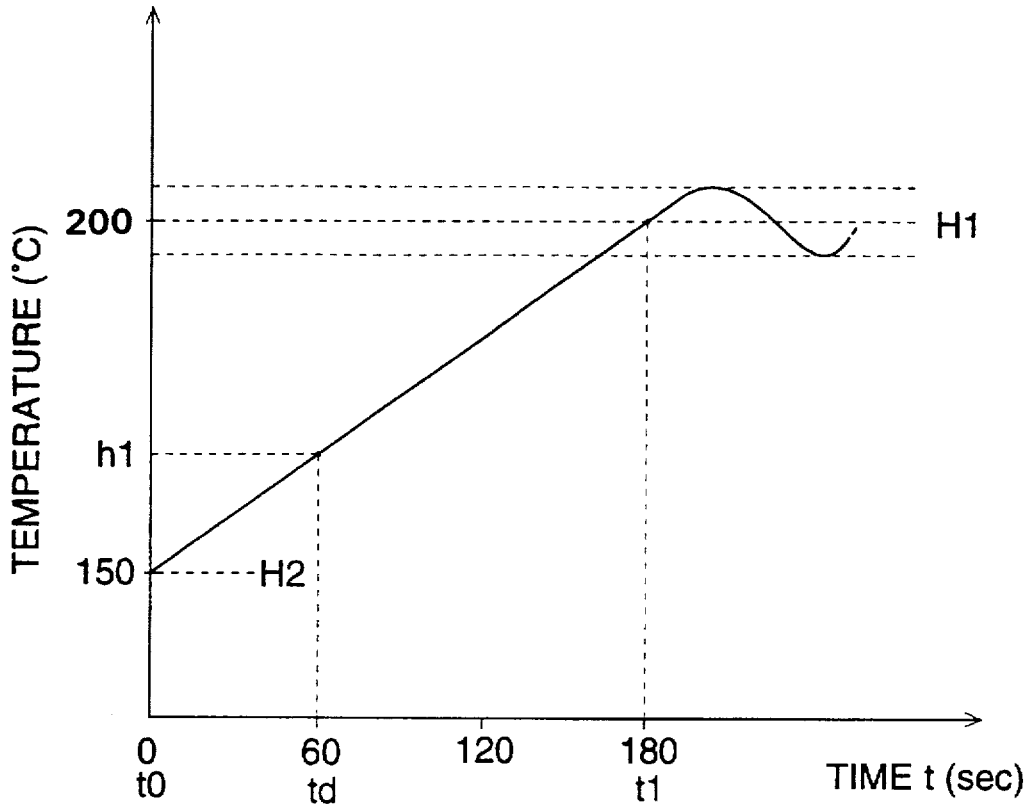
FIG. 9 is a diagram of characteristics showing temperature control for a heat roller following the switching of pixel density in an embodiment of the invention.
FIG. 10 is a table of characteristics showing the relation between establishment of second control temperature h2 and waiting time following the switching of pixel density in an embodiment of the invention.

FIG. 9 is a diagram of characteristics showing the behavior of a temperature of a heat roller (upper roller 73A). In this case, temperature set H2 in the second mode for high image quality (e.g., 150° C.) and temperature set H1 in the first mode for ordinary pixel density (e.g., 200° C.) are set. Incidentally, with regard to the temperatures set H1 and H2, each of them is controlled through turning on/turning off of a heater within a range from about +5° C. to about −5° C. both against a center value of the temperature set (upper limit and lower limit).

In such a case, pixel density is switched at time t0, and temperature set is switched from H2 to H1. Incidentally, temperature control having temperature set H2 before time t0 as a center is not illustrated.

In this case, though image forming has been allowed at the moment t1 (e.g., 180 sec.) when the heat roller temperature reaches H1, in the past, image forming in the present embodiment can be allowed at the moment td (e.g., approx. 60 sec.) by setting the first control temperature h1 to the temperature (e.g., 170° C.) which is lower than temperature set H1.

Incidentally, when the first control temperature h1 is changed, the time to wait until the moment when image forming is allowed is also changed.

<Other Embodiment>

In each embodiment mentioned above, it is preferable that the control temperature h1 or h2 can be changed to arbitrary temperature by a ten-key or the like on operation section 70.

In the function mentioned above, when a user needs printing out urgently, it is possible to shorten the waiting time without any serious problems in practical use though there is a slight possibility of insufficient fixing, whereby the function is preferable on the point that it can cope with a user's taste.

FIG. 10 is a diagram of characteristics showing the waiting time needed for reaching the second control temperature h2 under the condition of natural cooling. Based on this, it is also possible to set the waiting time, though it is also possible to set directly the second control temperature h2 by means of a ten-key on operation section 70.

FIG. 11 is a diagram of characteristics showing the waiting time needed for reaching the second control temperature h2 under the condition that heat is radiated to either one roller which is lower in terms of temperature through rotation of the upper and lower rollers. Even in this case, it is also possible to set the waiting time, though it is also possible to set directly the second control temperature h2 by means of a ten-key on operation section 70.

FIG. 12 is a diagram of characteristics showing the waiting time needed for reaching the second control temperature h2 under the condition that cooling is conducted by both rotation of the upper and lower rollers and air cooling. Even in this case, it is also possible to set the waiting time, though it is also possible to set directly the second control temperature h2 by means of a ten-key on operation section 70.

Incidentally, when temperatures set H1 and H2 are controlled within a range of ±5° C. in terms of temperature, it is preferable that the control temperature h1 or h2 is within a range from temperature set H1−5° C. in the first mode to temperature set H2+5° C. in the second mode. When setting can be conducted within this range, insufficient fixing can be prevented, and image forming operations are not started even when a user changes, by mistake, to the control temperature that is out of the range, which solves a problem caused by extremely insufficient fixing.

It is more preferable that the control temperature h1 is selected to be about temperature set H1−5° C. (lower limit of a control range of temperature set H1) and the control temperature h2 is selected to be about temperature set H2+5° C. (upper limit of temperature set H2). Namely, it is possible to conduct positive fixing by selecting the control temperatures in the way mentioned above, because the control temperatures H1 and H2 are controlled within a range of ±5° C.

What is claimed is:

1. An image forming apparatus having a first mode for image forming at a first recorded pixel density and a second mode for image forming at a second recorded pixel density that is higher than that in the first mode, the apparatus comprising:

(a) selecting means for selecting either the first mode or the second mode;

(b) a fixing unit having a temperature detecting sensor to detect a temperature of the fixing unit; and (c) control means for changing a temperature condition to be set for the fixing unit in accordance with a change between the first recorded pixel density and the second recorded pixel density selected by the selecting means, wherein when the first mode is changed to the second mode by the selecting means, the control means controls to switch the temperature condition of the fixing unit from a high temperature condition H1 in the first mode to a low temperature condition H2 in the second mode that is lower than that of the high temperature condition H1, provides a predetermined second control temperature h2 within a range between the temperature condition H1 and the temperature condition H2 to control inhibiting or allowing an image forming, and controls to inhibit the image forming when a temperature detected by the sensor is higher than the second control temperature h2 and to allow the image forming when the temperature detected by the sensor is less than the second control temperature h2.

2. The image forming apparatus of claim 1 further comprising a control temperature changing means for changing the second control temperature h2.

3. The image forming apparatus of claim 2, wherein the control means controls the second control temperature h2 in a range between the temperature condition H1 and the temperature condition H2 according to an operation of the control temperature changing means.

4. The image forming apparatus of claim 1, wherein when a temperature of the fixing unit detected by the temperature detecting sensor is more than the second control temperature h2, the control means controls to drive upper and lower rollers of the fixing unit to rotate.

5. The image forming apparatus of claim 1 further comprising a cooling means for cooling the fixing unit, wherein when the temperature of the fixing unit is higher than the second control temperature h2, the control means controls to drive the cooling means to operate.

6. The image forming apparatus of claim 1, wherein when the second mode is changed to the first mode by the selecting means, the control means controls to switch the temperature condition of the fixing unit from the temperature condition H2 in the second mode to the temperature condition H1 in the first mode, provides a predetermined first control temperature h1 between the temperature condition H1 and the temperature condition H2 to control inhibiting or allowing the image forming, and controls to inhibit the image forming when the temperature detected by the sensor is lower than the first control temperature h1 and to allow the image forming when the temperature detected by the sensor is higher than the first control temperature h1.

7. The image forming apparatus of claim 6 further comprising a control temperature changing means for changing the first control temperature h1.

8. The image forming apparatus of claim 1, wherein the control means controls a drive speed of the fixing unit according to the change between the first recorded pixel density and the second recorded pixel density selected by the selecting means, and the drive speed of the fixing unit is changed in association with a drive speed of a photoreceptor.

9. A control method for an image forming apparatus having a first mode for image forming at a first recorded pixel density and a second mode for image forming at a second recorded pixel density and is higher than that in the first mode, the image forming apparatus being provided with a fixing unit including a temperature detecting sensor to detect a temperature of the fixing unit, the control method comprising the steps of:

(a) switching a temperature condition to be set for the fixing unit from a high temperature condition H1 in the first mode to a low temperature condition H2 in the second mode lower than that of the temperature condition H1, when the first mode is changed to the second mode;

(b) providing a predetermined second control temperature h2 within a range between the temperature condition H1 and the temperature condition H2 to control inhibiting or allowing an image forming; and (c) inhibiting the image forming when a temperature detected by the sensor is higher than the second control temperature h2, and allowing the image forming when the temperature detected by the sensor is lower than the second control temperature h2.

10. The control method of claim 9 further comprising changing the second control temperature h2.

11. The control method of claim 10, comprising allowing a change of the second control temperature h2 in the range between the temperature condition H1 and the temperature condition H2.

12. The control method of claim 9, wherein when a temperature of the fixing unit detected by the temperature detecting sensor is higher than the second control temperature h2, comprising driving upper and lower rollers of the fixing unit to rotate.

13. The control method of claim 9, wherein when a temperature of the fixing unit detected by the temperature detecting sensor is higher than the second control temperature h2, comprising cooling the fixing unit.

14. The control method of claim 9, comprising:

switching the temperature condition for the fixing unit from the temperature condition H2 in the second mode to the temperature condition H1 in the first mode, when the second mode is changed to the first mode;

providing a predetermined first control temperature h1 within a range between the temperature condition H1 and the temperature condition H2 to control inhibiting or allowing the image forming; and inhibiting the image forming when a temperature detected by the sensor is lower than the first control temperature h1, and allowing the image forming when the temperature detected by the sensor is higher than the first control temperature h1.

15. The control method of claim 14 further comprising changing the first control temperature h1.

16. The control method of claim 14, comprising establishing the first control temperature h1 within a range between a temperature higher than the temperature condition H2 by 5° C. and a temperature lower than the temperature condition H1 by 5° C.

17. The control method of claim 9, comprising establishing the second control temperature h2 within a range between a temperature higher than the temperature condition H2 by 5° C. and a temperature lower than the temperature condition H1 by 5° C.

18. The control method of claim 9, comprising controlling a drive speed of the fixing unit according to the change between the first recorded pixel density and the second pixel density, and changing the drive speed of the fixing unit in association with a drive speed of a photoreceptor.

* * * * *